US011566758B2

(12) United States Patent
Zhou et al.

(10) Patent No.: US 11,566,758 B2
(45) Date of Patent: Jan. 31, 2023

(54) LUMINAIRE

(71) Applicant: TIJO LIGHTING (NINGBO) CO., LTD., Ningbo (CN)

(72) Inventors: Qian Zhou, Ningbo (CN); Lewen Chang, Ningbo (CN); Jizhong Li, Ningbo (CN); Rui Gong, Ningbo (CN)

( * ) Notice: Subject to any disclaimer, the term of this patent is extended or adjusted under 35 U.S.C. 154(b) by 0 days.

(21) Appl. No.: 17/450,829

(22) Filed: Oct. 28, 2021

(65) Prior Publication Data

US 2022/0178505 A1 Jun. 9, 2022

(51) Int. Cl.

| | |
|---|---|
| ***F21S 4/28*** | (2016.01) |
| ***F21V 21/008*** | (2006.01) |
| ***F21V 29/70*** | (2015.01) |
| *F21Y 115/10* | (2016.01) |

(52) U.S. Cl.

CPC ..... *F21S 4/28* (2016.01); *F21V 21/008* (2013.01); *F21V 29/70* (2015.01); *F21Y 2115/10* (2016.08)

(58) Field of Classification Search

CPC ..... F21S 4/28; F21S 2/00; F21S 8/061; F21V 21/008; F21V 29/70; F21V 15/015; F21V 21/14; F21V 23/06; F21Y 2115/10; Y02P 60/14

See application file for complete search history.

(56) References Cited

U.S. PATENT DOCUMENTS

| | | | | |
|---|---|---|---|---|
| 2009/0303711 | A1* | 12/2009 | Remus | F21V 15/01 362/234 |
| 2017/0023193 | A1* | 1/2017 | Thosteson | F21V 23/003 |
| 2019/0309929 | A1 | 10/2019 | Hadjian et al. | |
| 2021/0071820 | A1 | 3/2021 | Bennette | |
| 2021/0116085 | A1 | 4/2021 | Butala et al. | |

* cited by examiner

*Primary Examiner* — Rajarshi Chakraborty
*Assistant Examiner* — Glenn D Zimmerman
(74) *Attorney, Agent, or Firm* — Rumit Ranjit Kanakia

(57) ABSTRACT

The present disclosure discloses a luminaire, including a supporting frame, a power supply device, a left bracket, and a right bracket. The side edge of the left bracket is provided with a plurality of left fixed frames; the side edge of the right bracket is provided with right fixed frames symmetric to the left fixed frames one by one; one LED bar is buckled between the symmetric left fixed frame and right fixed frame in each group; the right fixed frames and the left fixed frames include box type brackets; the front and rear ends of each box type bracket are provided with buckle slots; the left and right ends of each LED bar are each provided with one bar plug; the inner sides of the box type brackets of the right fixed frames are provided with female head copper pins.

10 Claims, 16 Drawing Sheets

LUMINAIRE

TECHNICAL FIELD

The present disclosure relates to the technical field of luminaires, and specifically to the luminaire.

BACKGROUND

The lighting environment is one of the important physical environmental factors that are indispensable for plant growth. Controlling building of plant morphology through light quality regulation is an important technology in the field of facility cultivation. Grow lights simulate the principle that plants need the sunlight for photosynthesis. For supplementing light for plants or completely replacing the sunlight, the grow lights are very suitable for growth, flowering, and fruiting of the plants. In order to provide sufficient light to the plants, luminaires will be added.

The existing luminaire has several following technical problems:

1. During mounting of the luminaire, due to the relatively complex structure, the luminaire needs to be operated and mounted by professionals, which is inconvenient, time-consuming and labor-intensive.

2. Currently, in order to change the lighting angle, the whole fixture needs to be adjusted. That results in one-direction illumination and limits the projected area, and impacts the lighting effects. The goals of wide-range, multi-angle illumination, quick dismantling and rotate-to-adjust function are not fulfilled.

Therefore, the current luminaire needs to be improved.

SUMMARY

The present disclosure aims to provide a luminaire, so as to solve the problems of inconvenient, time-consuming and labor-intensive installation and incapability of satisfying wide-range, multi-angle illumination as stated above.

To achieve the above-mentioned purpose, the present disclosure provides the following technical solution: a luminaire, including a supporting frame, a power supply device, and one or more LED bars. The power supply device is fixed on the supporting frame. Two sides of the supporting frame are provided with a bracket on each side; one or more left fixed frames are fixed on the side edge of the left bracket; right fixed frames symmetric to the left fixed frames one by one are fixed on the side edge of the right bracket; one LED bar is buckled between the symmetric left fixed frame and right fixed frame in each group; the right fixed frames and the left fixed frames each include one box type brackets; the front and rear ends of each box type bracket are each provided with one buckle slot; the left and right ends of each LED bar are each provided with one bar plug; the inner sides of the box type brackets of the right fixed frames are provided with female head copper pins electrically connected to the power supply device; the bar plugs on the right sides are provided with male head copper pins; one end of each male head copper pin is matched with each female head copper pin, and the other end is electrically connected to each LED bar; the front and rear ends of each bar plug are each provided with one elastic buckle; the elastic buckles cooperate with the buckle slots; the right fixed frames and the left fixed frames are rotatably connected with the corresponding left bracket or right bracket through one angle adjustment mechanism; the angle adjustment mechanism includes one rotating part, two elastic positioning devices symmetrically fixed on two sides of the rotating part, and two angle adjustment limiting regions cooperating with the two elastic positioning devices; and each angle adjustment limiting region includes one or more angle adjustment gears.

As a preference, the left bracket and the right bracket are provided with limiting holes cooperating with the rotating parts and positioning holes cooperating with the elastic positioning devices; one end of each rotating part is connected with the box type brackets; the two angle adjustment limiting regions are two symmetric arc-shaped limiting slots formed in the back surfaces of the box type brackets; each group of arc-shaped limiting slot is formed by splicing one or more semicircular grooves; two adjacent semicircular grooves communicate with each other; an included angle between two circle centers of two adjacent semicircular grooves is 0 to 10 degrees; the bottoms of the elastic positioning devices on two sides of the rotating parts are snapped in the corresponding positioning holes; and elastic ends of the elastic positioning devices on two sides are mounted in the left and right symmetric semicircular grooves.

In order to improve the waterproofing effect, a limiting pillar is fixed in each box type bracket; the female head copper pins are of L-shaped structures; one end of each female head copper pin is plugged in the limiting pillar of the right fixed frame; one or more connection guide wire groups are fixed in the right bracket; one end of each connection guide wire group is electrically connected to the power supply device, and the other end of each connection guide wire group is connected with the female head copper pin on the right fixed frame; a rotatable limiting slot is formed in the right bracket; the female head copper pins in the right fixed frames are clamped in the rotatable limiting slot; positioning slots are formed in the bar plugs on the right sides; the male head copper pins are inserted into the positioning slots; the limiting pillars are plugged into the positioning slots; and second waterproof pads are fixed on the back surfaces of the box type brackets.

Further, in order to ensure that the wiring is stabler, the box type bracket and the female head copper needle are formed by integrated encapsulation; one end of the female head copper needle is provided with a copper sleeve; the male head copper needle and the bar plug (11) are formed by integrated encapsulation; the male head copper needle is of an L-shaped structure; and one end of the male head copper needle is plugged into the copper sleeve.

For convenience of operation, each elastic buckle includes an elastic body with the upper end connected with the bar plug; the elastic body is provided with a triangular hook part; one end part of the triangular hook part is outwards disposed and cooperates with the buckle slot; a bent part is fixed below the triangular hook part; an operation extending part is fixed below the bent part; and the operation extending part downwards extends out of a lower opening of the box type bracket.

In order to improve the illumination effect, one reflector is connected above each LED bar through a thumb screw; and a reflection angle of the reflector is 50-90 degrees.box type mounting platebox type mounting plate As a preference, for convenience of installation and removal, each of the left bracket and the right bracket is provided with one or more triangular positioning hooks; each triangular positioning hook is hung with a steel wire rope; and two ends of the steel wire rope are provided with mounting hooks.

As a preference, in order to further improve the waterproofing effect, each of the left bracket and the right bracket includes a bracket main body and a bracket side plate; the bracket side plate is in buckled connection with the bracket main body; each of two ends of the bracket main body is provided with an end cover; a first waterproof pad is fixed between each end cover and the bracket main body; and one or more waterproof bars are fixed in the bracket side plate.

As a preference, for convenience of removal, the rotating part is an adjustment bolt; and a built-in nut in threaded connection with the adjustment bolt is fixed in the box type bracket.

As a preference, in order to improve the heat dissipation effect, each LED bar includes an aluminum heat dissipation luminaire holder and an LED panel with LED beads; and the LED panel is fixed on the lower surface of the aluminum heat dissipation luminaire holder.

As a preference, the upper surface of the aluminum heat dissipation luminaire holder is provided with a first heat dissipation insertion slot that is inwards sunken; the first heat dissipation insertion slot extends in a lengthwise direction of the aluminum heat dissipation luminaire holder; two sides of the first heat dissipation insertion slot are provided with one or more first heat dissipation racks; and the thumb screw is in threaded fit with the first heat dissipation insertion slot.

As a preference, the upper surface of the aluminum heat dissipation luminaire holder is provided with a heat dissipation groove; a screw fixing slot extending downwards is fixed in the heat dissipation groove; the screw fixing slot is in cooperating connection with the thumb screw; the heat dissipation groove and the screw fixing slot extend in the lengthwise direction of the aluminum heat dissipation luminaire holder; one or more first heat dissipation ribs extending upwards are further fixed in the heat dissipation groove; and two sides of the aluminum heat dissipation luminaire holder are provided with one or more second heat dissipation ribs.

The present disclosure has the following technical effects: the structure has the advantages that the mounting structure is simple, the operation is convenient, the angle of each light bar is independently adjustable, an illumination angle range is finally guaranteed to be wider, and large-range multi-angle illumination is satisfied. Meanwhile, the luminaire of this structure can also realize quick dismantling and rotate-to-adjust functions.

Figure 1:
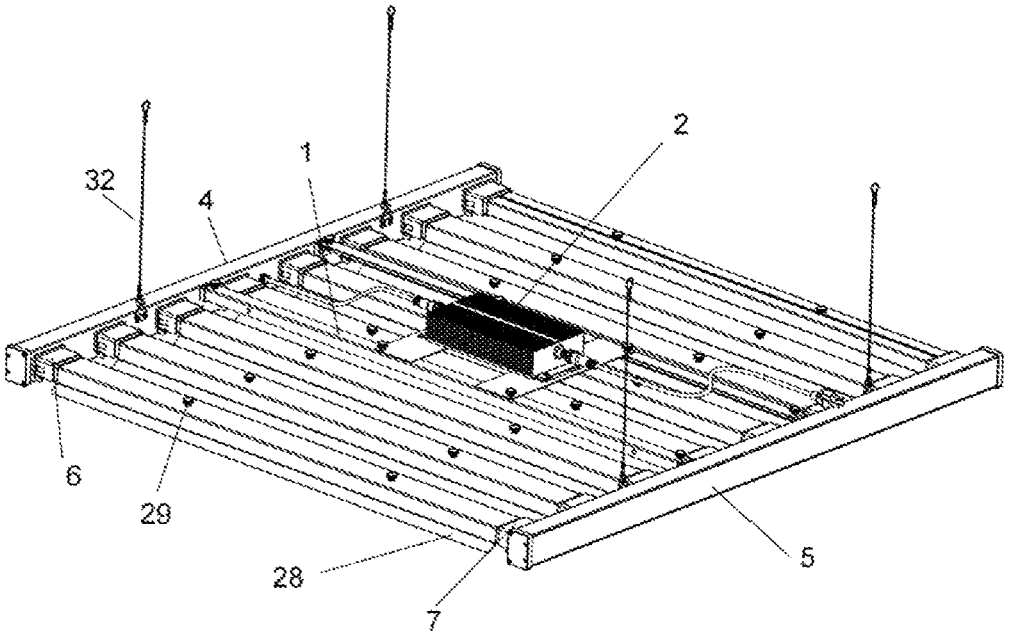
FIG. 1 is an integrally schematic diagram of an entire structure of a luminaire in Embodiment 1.
Figure 2:
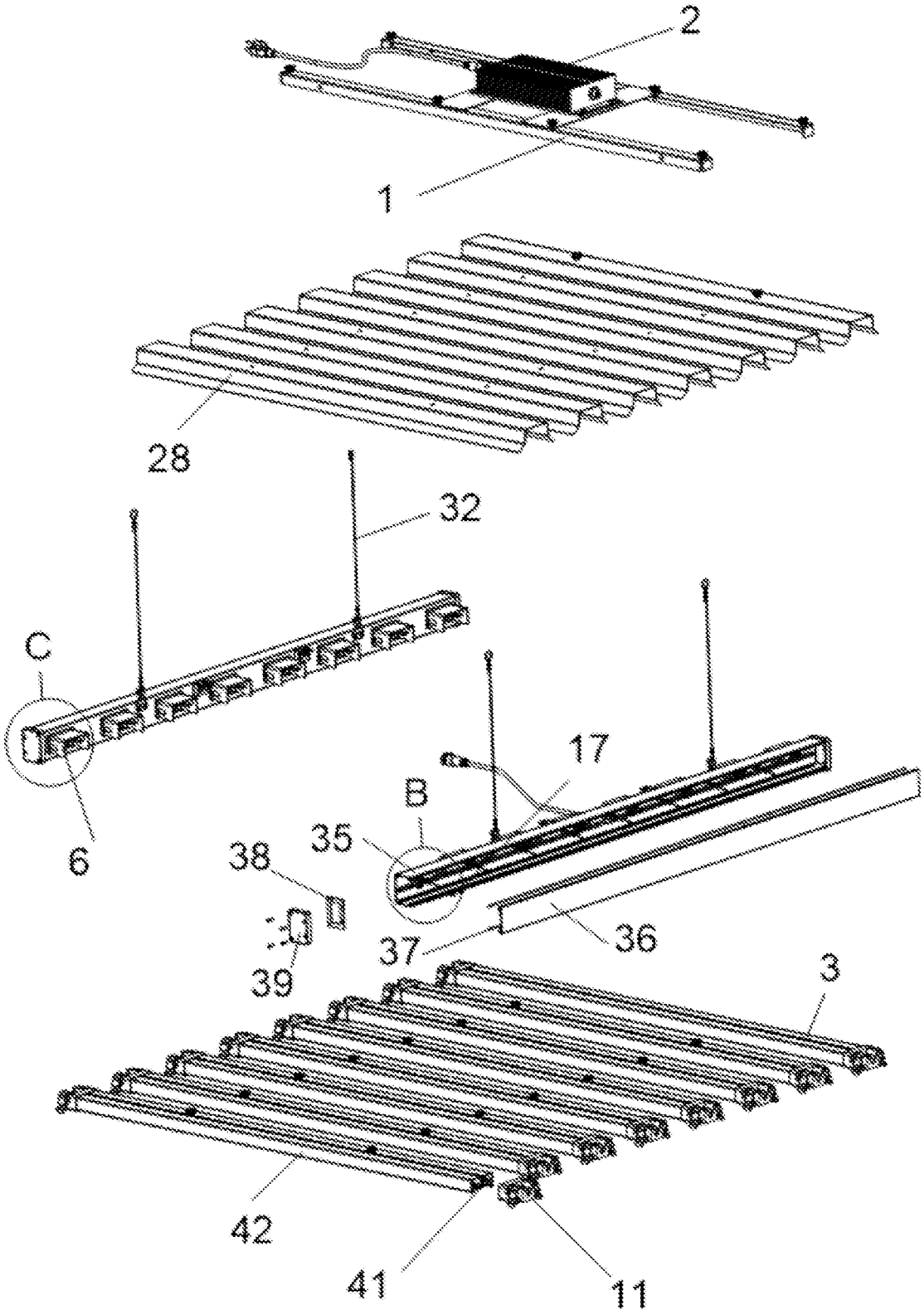
FIG. 2 is an integrally schematic diagram of an exploded structure of a luminaire in Embodiment 1.
Figure 3:
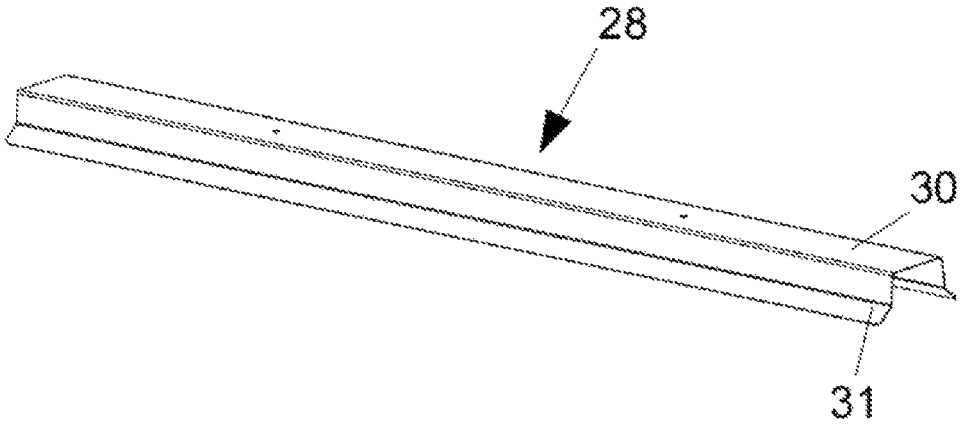
FIG. 3 is a schematic structural diagram of a reflector in Embodiment 1.
Figure 4:
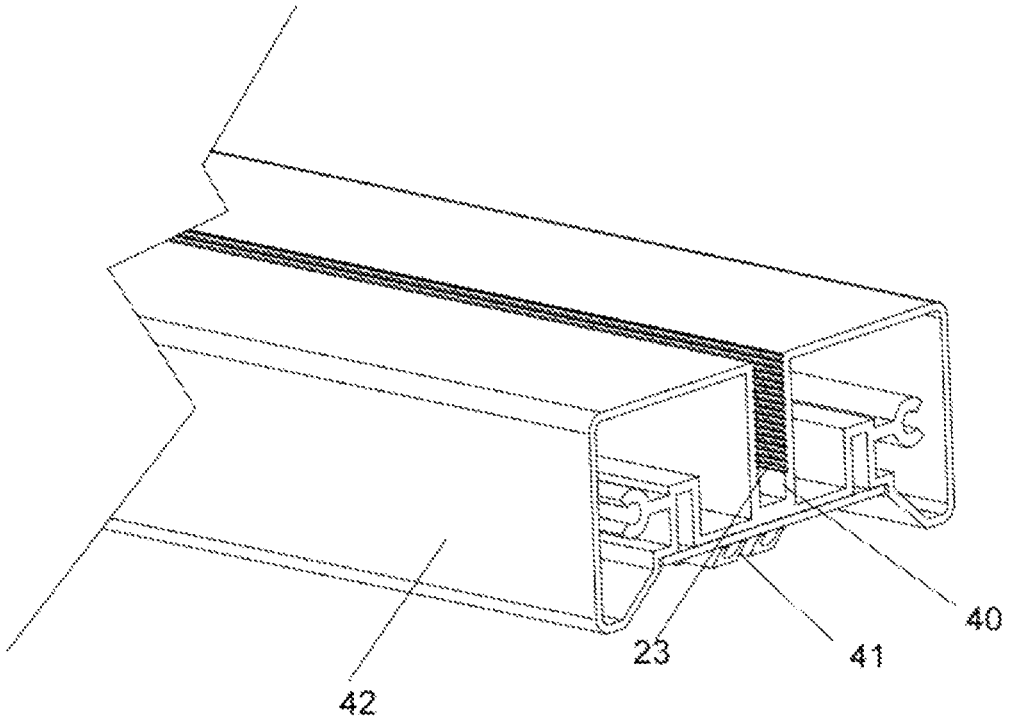
FIG. 4 is a partially schematic structural diagram of an LED bar.
Figure 5:
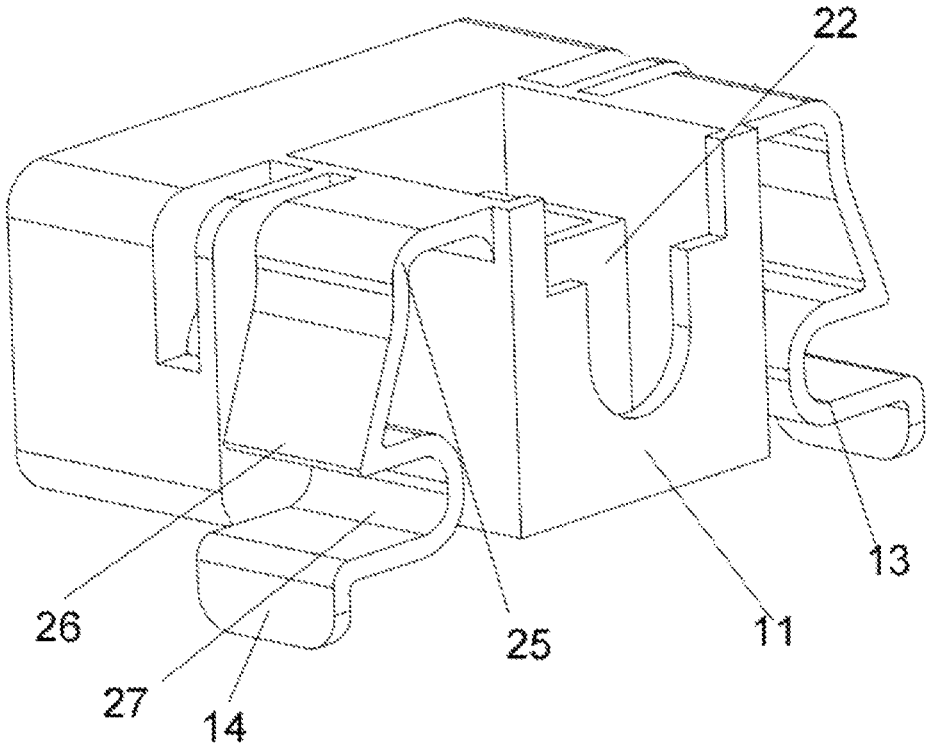
FIG. 5 is a schematic structural diagram of a bar plug on the right side.
Figure 6:
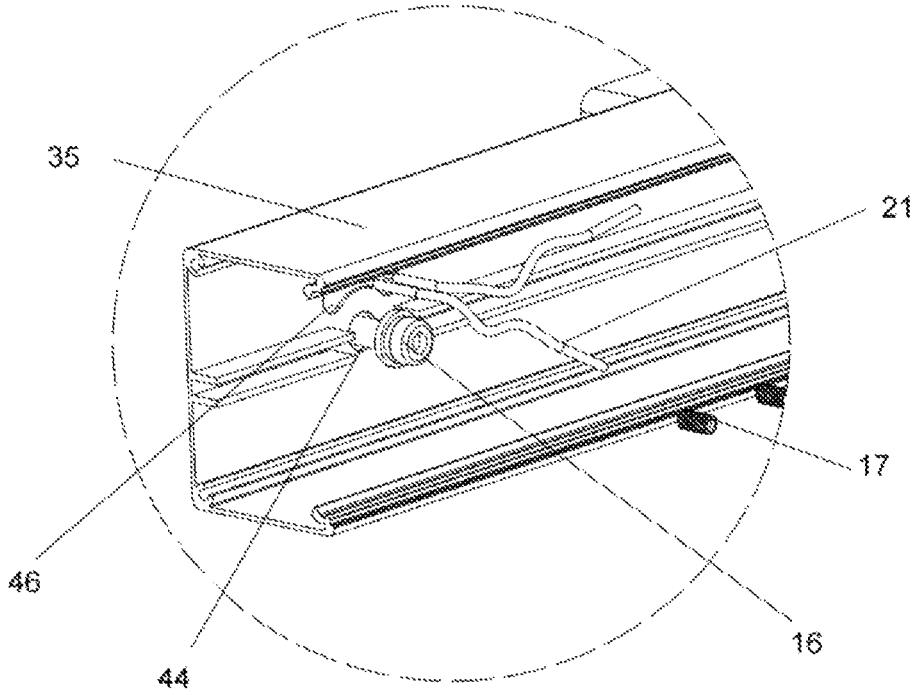
FIG. 6 is an enlarged diagram of the part B of FIG. 2.
Figure 7:
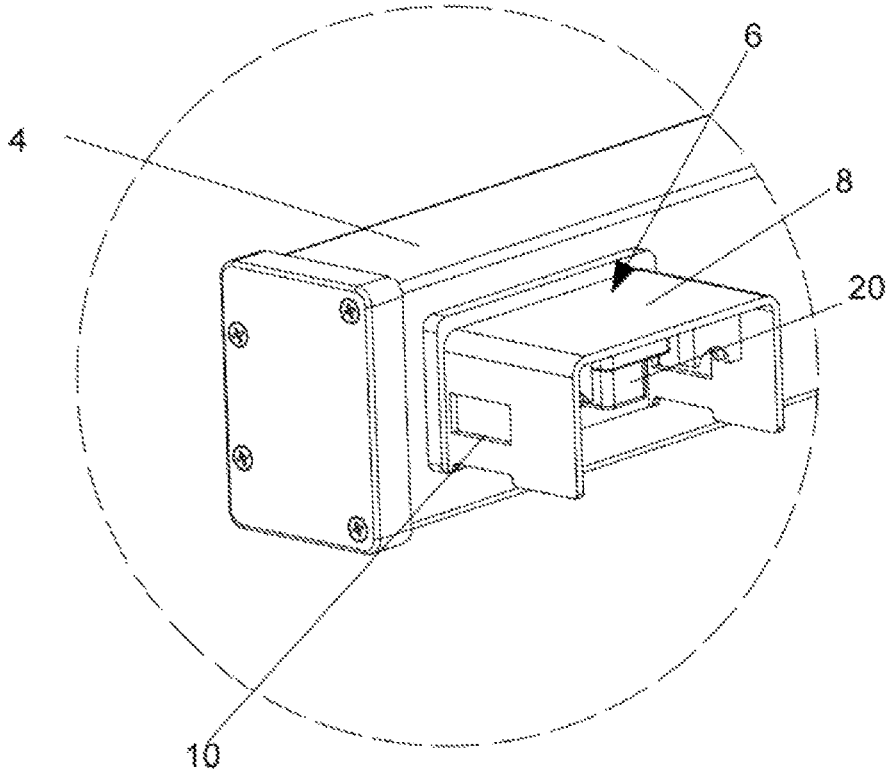
FIG. 7 is an enlarged diagram of the part C of FIG. 2.
Figure 8:
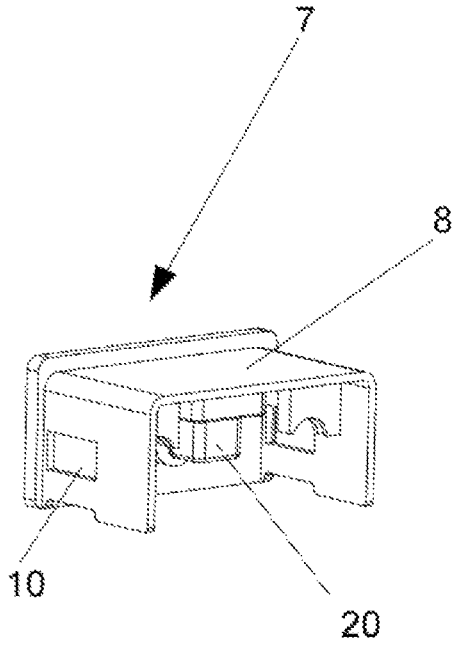
FIG. 8 is a schematic structural diagram of a left fixed frame on the left side.
Figure 9:
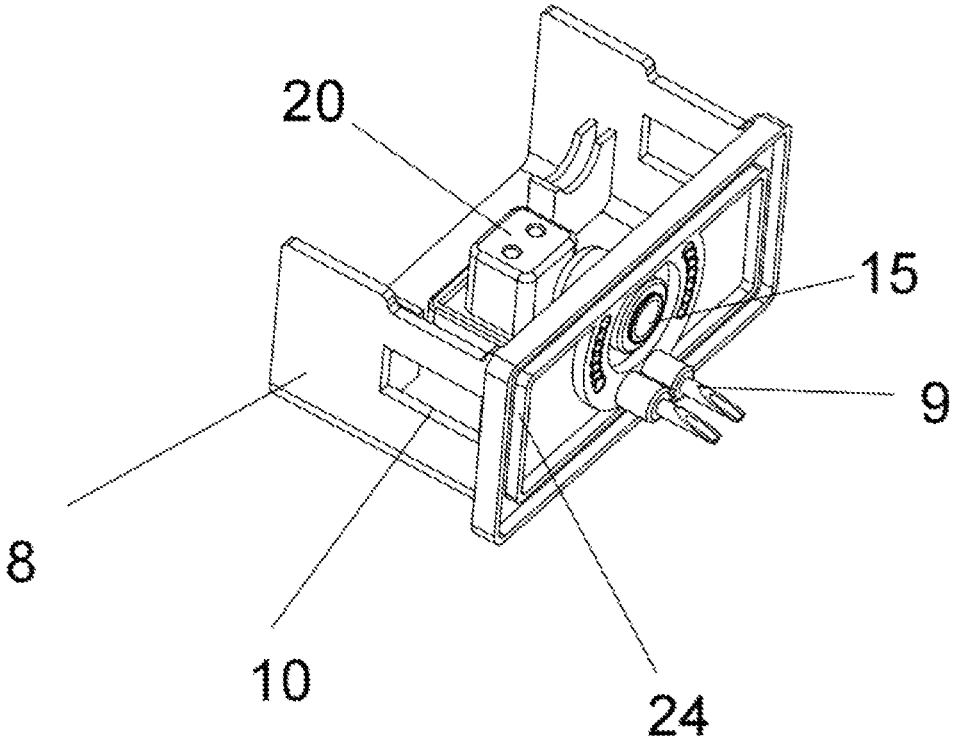
FIG. 9 is a three-dimensional structural bottom view of a right fixed frame on the right side.
Figure 10:
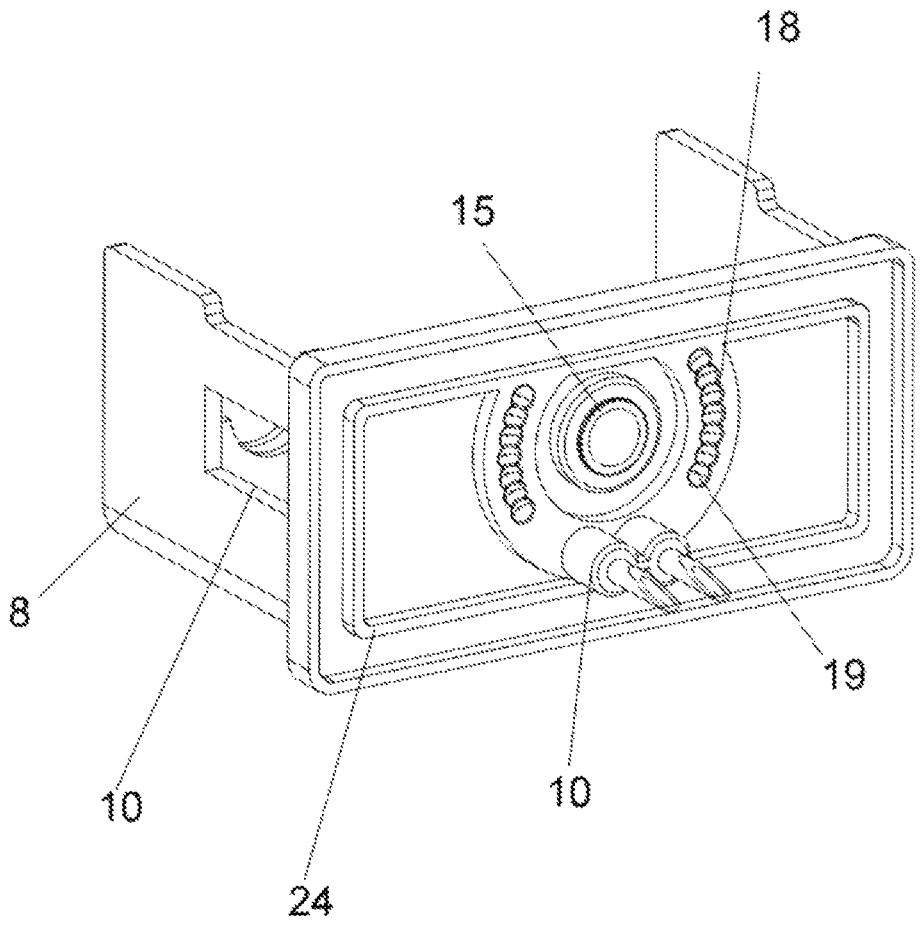
FIG. 10 is a schematic structural diagram when the back surfaces of box type brackets in FIG. 9 all face forwards.
Figure 11:
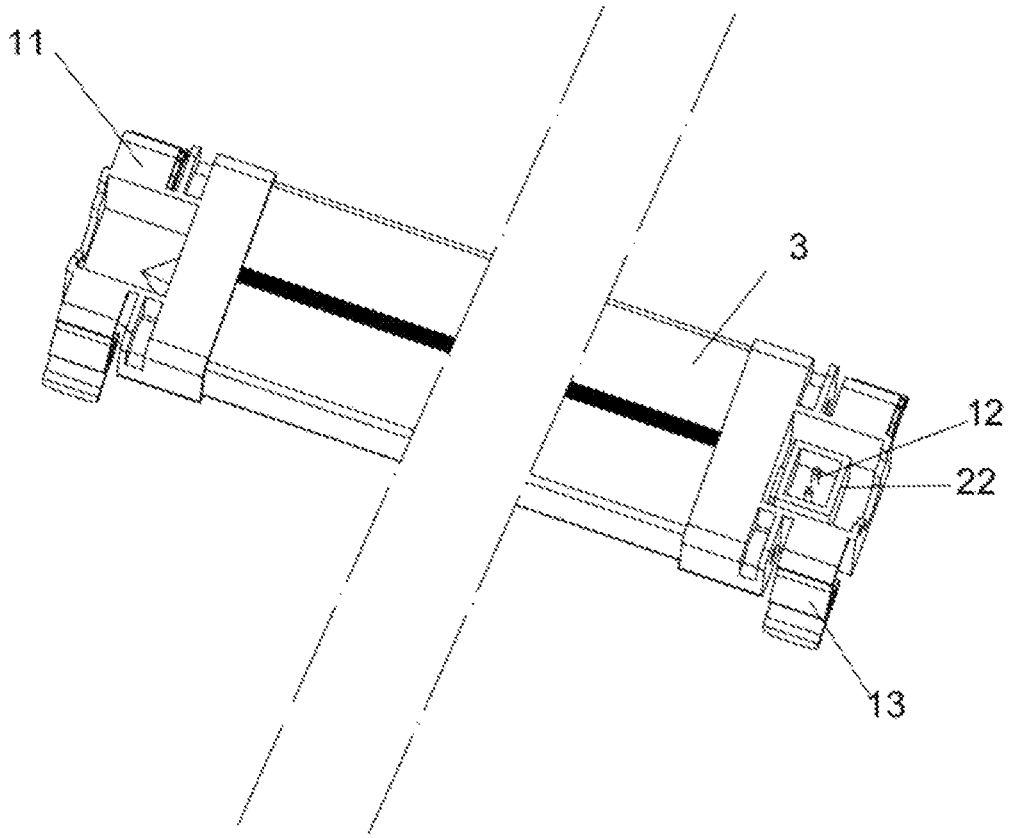
FIG. 11 is a schematic structural diagram of an LED bar.
Figure 12:
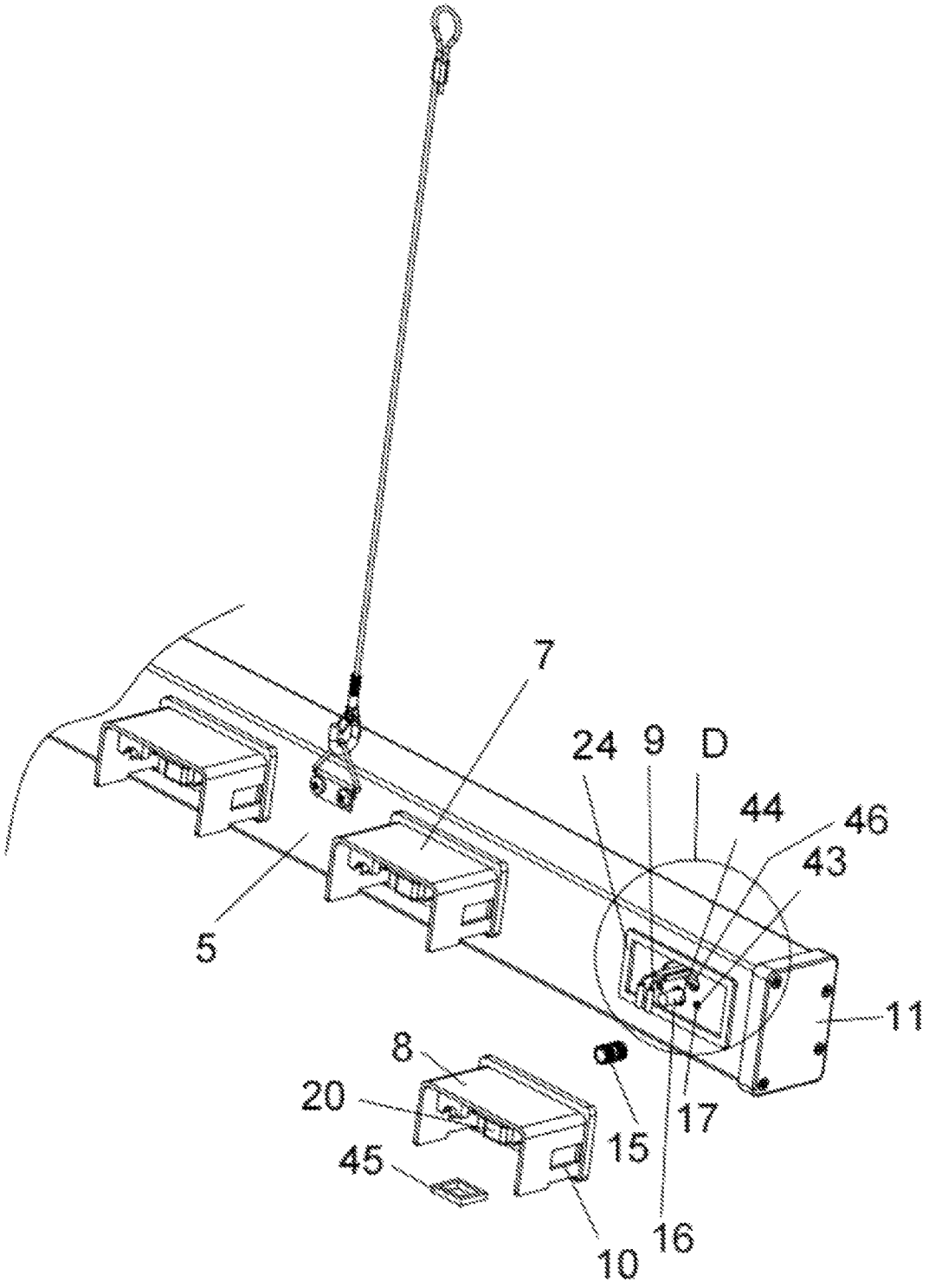
FIG. 12 is a schematic structural diagram when one box type bracket is separated from the right bracket.
Figure 13:
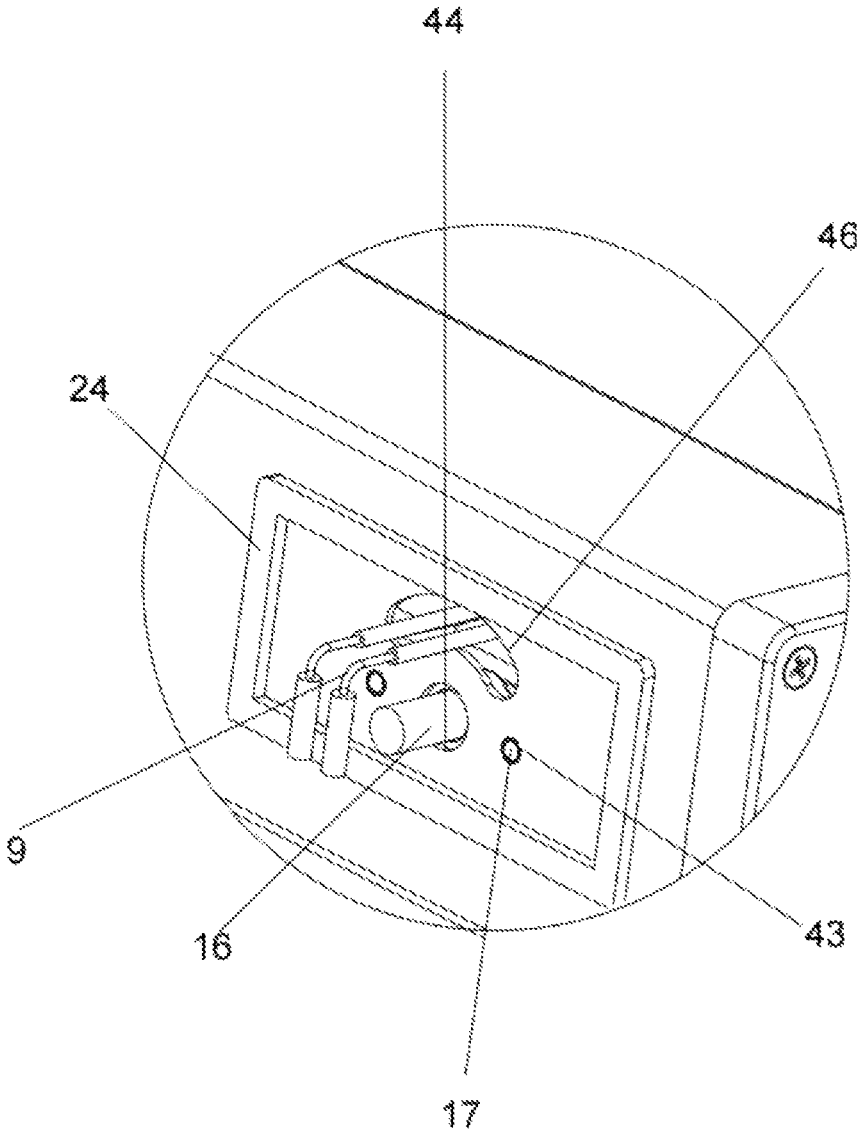
FIG. 13 is an enlarged diagram of the part D of FIG. 12.

In the drawings: 1: supporting frame; 2: power supply device; 3: LED bar; 4: left bracket; 5: right bracket; 6: left fixed frame; 7: right fixed frame; 8: box type bracket; 9: female head copper pin; 10: buckle slot; 11: bar plug; 12: female head copper pin; 13: elastic buckle; 14: operation extending part; 15; built-in nut; 16: rotating part; 17: elastic positioning device; 18: arc-shaped limiting slot; 19: semi-circular groove; 20: limiting pillar; 21: connection guide wire group; 22: positioning slot; 23: first heat dissipation rack; 24: second waterproof pad; 25: elastic body; 26: triangular hook part; 27: bent part; 28: reflector; 29: thumb screw; 30: box type mounting plate; 31: light reflection inclined plate; 32: steel wire rope hook; 33: screw fixing slot; 34: heat dissipation groove; 35: bracket main body; 36: bracket side plate; 37: waterproof bar; 38: first waterproof pad; 39: end cover; 40: first heat dissipation insertion slot; 41: LED panel; 42: aluminum heat dissipation luminaire holder; 43: positioning hole; 44: limiting hole; 45: third waterproof pad; 46: rotatable limiting slot; 47: angle adjustment limiting region; 47-1: angle adjustment gear; 48: first heat dissipation rib; 49: second heat dissipation rib; 9-1: copper sleeve; and 3-1: patch connector

DETAILED DESCRIPTION OF THE EMBODIMENTS

The following clearly and completely describes the technical solution in the embodiments of the present disclosure in combination with the accompanying drawings of the embodiments of the present disclosure. Apparently, the described embodiments are only part of the embodiments of the present disclosure, not all embodiments. Based on the embodiments in the disclosure, all other embodiments obtained by those of ordinary skill in the art without creative work shall fall within the protection scope of the present disclosure.

In the description of the present disclosure, it should be noted that orientations or positional relationships indicated by the terms "upper", "lower", "inside", "outside", "front end", "rear end", "two ends", "one end", "the other end" and the like are orientations or positional relationships as shown in the drawings, and are only for the purpose of facilitating and simplifying the description of the present disclosure instead of indicating or implying that devices or elements indicated must have particular orientations, and be constructed and operated in the particular orientations, so that these terms are construed as limiting the present disclosure. In addition, the terms "first" and "second" are only for the purpose of description, and may not be understood as indicating or implying the relative importance.

In the description of the present disclosure, it should be noted that unless otherwise explicitly specified and defined, the terms "installed", "provided with" and "connected" shall be understood broadly. For example, "connected" may be fixedly connected, or detachably connected, or integrally connected, or mechanically connected, or electrically connected, or directly connected, or indirectly connected through an intermediate medium, or interconnection between two elements. Those of ordinary skill in the art can understand the specific meanings of the above terms in the present disclosure according to specific situations.

Embodiment 1

Figure 14:
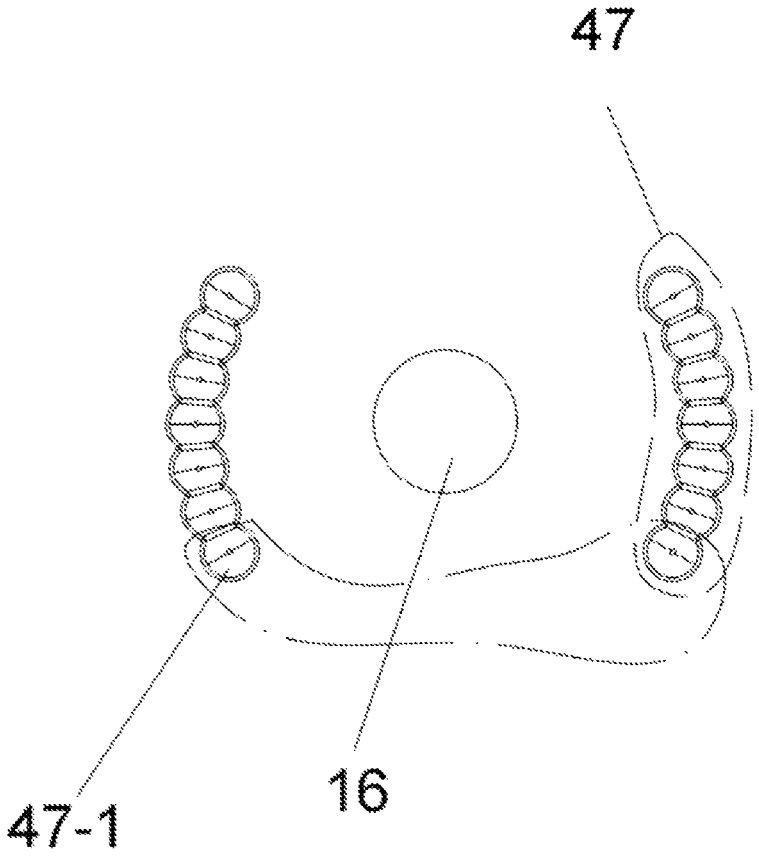
FIG. 14 is a schematic structural diagram of front distribution of angle adjustment limiting regions and a rotating part.

Referring to FIG. 1 to FIG. 14, a luminaire disclosed by the present embodiment includes a supporting frame 1, a power supply device 2, and one or more LED bars 3. The power supply device 2 is fixed on the supporting frame 1. Two sides of the supporting frame 1 are provided with a left bracket 4 and a right bracket 5; one or more left fixed frames 6 are fixed on the side edge of the left bracket 4; right fixed frames 7 symmetric to the left fixed frames 6 one by one are fixed on the side edge of the right bracket 5; one LED bar 3 is buckled between the symmetric left fixed frame 6 and right fixed frame 7 in each group; the right fixed frames 7 and the left fixed frames 6 each include one box type bracket 8; the front and rear ends of each box type bracket 8 are each provided with one buckle slot 10; the left and right ends of each LED bar 3 are each provided with one bar plug 11; the inner sides of the box type brackets 8 of the right fixed frames 7 are provided with female head copper pins 9 electrically connected to the power supply device 2; the bar plugs 11 on the right sides are provided with male head copper pins 12; one end of each male head copper pin 12 is matched with each female head copper pin 9, and the other end is electrically connected to each LED bar 3; the front and rear ends of each bar plug 11 are each provided with one elastic buckle 13; the elastic buckles 13 cooperate with the buckle slots 10; the right fixed frames 7 and the left fixed frames 6 are rotatably connected with the corresponding left bracket 4 or right bracket 5 through one angle adjustment mechanism; as shown in FIG. 14, the angle adjustment mechanism includes one rotating part 16, two elastic positioning devices 17 symmetrically fixed on two sides of the rotating part 16, and two angle adjustment limiting regions 47 cooperating with the two elastic positioning devices 17; and each angle adjustment limiting region 47 includes one or more angle adjustment gears 47-1. The box type bracket in the present embodiment is of a "⊔"-shaped structure.

As a preference, the left bracket 4 and the right bracket 5 are provided with limiting holes 44 cooperating with the rotating parts 16 and positioning holes 43 cooperating with the elastic positioning devices 17; one end of each rotating part 16 is connected with the box type brackets 8; the two angle adjustment limiting regions 47 are two symmetric arc-shaped limiting slots 18 formed in the back surfaces of the box type brackets 8; each group of arc-shaped limiting slot 18 is formed by splicing one or more semicircular grooves 19; two adjacent semicircular grooves 19 communicate with each other; an included angle between two circle centers of two adjacent semicircular grooves 19 is 0 to 10 degrees; the bottoms of the elastic positioning devices 17 on two sides of the rotating parts 16 are snapped in the corresponding positioning holes 43; elastic ends of the elastic positioning devices 17 on two sides are mounted in the left and right symmetric semicircular grooves 19; and the left and right symmetric semicircular grooves 19 on the same box type bracket 8 form one angle adjustment gear 47-1.

The elastic positioning device 17 in the present embodiment is an elastic positioning bead or elastic positioning pin.

During mounting, firstly, the left fixed frames 6 are sequentially mounted on the left bracket 4. During mounting, it is ensured that the rotating parts 16 on the left fixed frames 6 are rotatably connected to the left bracket 4; the right fixed frames 7 are sequentially mounted on the right bracket 5, and it is ensured that the rotating parts 16 on the right fixed frames 7 are rotatably connected to the right bracket 5; and meanwhile, during the mounting of the left fixed frames 6 and the right fixed frames 7, it is ensured that the elastic ends (i.e., movable beads of the elastic positioning beads or movable pins on the elastic positioning pins) of the elastic positioning devices 17 on two sides of the rotating parts 16 can be mounted in the left and right symmetric semicircular grooves 19 to realize limitation. During mounting of the LED bars 3, two sides of the LED bars 3 are held by hands and are snapped in the right fixed frames 7 and the left fixed frames 6 forcibly; the elastic buckles 13 on two sides are in buckling fit with the buckle slots 10; during later removal, the front and back elastic buckles 13 on the left side are directly held with the thumb and the index finger of the left hand, and the front and back elastic buckles 13 on the right side are held with the thumb and the index finger of the right hand; the two hands clench the elastic buckles towards the centers of the box type brackets 8 at the same time to finally ensure that the upper elastic buckles 13 are separated from the buckle slots 10 to realize removal; therefore, the whole mounting and removal operations are relatively convenient; in addition, during mounting, it is ensured that the female head copper pins 9 on the right side are plugged with the male head copper pins 12; after plugging, the female head copper pins 9 are electrically connected with the power supply device 2 by using guide wires to realize loops to turn on the LEDs; furthermore, the left bracket 4 and the left fixed frames 6 are in rotatable limiting connection, and the right fixed frames 7 and the right bracket 5 are in rotatable limiting connection, so as to ensure that angle rotation can be performed on the single LED bars 3 according to a need and ensure that the illumination angle of each LED bar 3 is different, so that the whole equipment has a wider illumination angle range; and therefore, this structure has the advantages that the mounting structure is simple, the operation is convenient, the angle of each light bar is independently adjustable, an illumination angle range is finally guaranteed to be wider, and large-range multi-angle illumination is satisfied. In addition, when the LED bar 3 needs to be rotated by an angle, the LED bar 3 is rotated by holding it with a hand. In the rotating process, the rotating parts 16 on two sides of the bar are rotatably connected into the limiting holes 44. Therefore, the LED bar 3 can be rotated by taking the limiting holes 44 as centers. During the rotation, when the elastic positioning devices 17 on two sides of the rotating parts 16 are locked in the corresponding positioning holes 43, positioning and angle adjustment for the LED bar 3 are realized, and finally the illumination direction is changed. Therefore, this structure realizes quick dismantling of each bar by means of buckle cooperation. Meanwhile, the rotate-to-adjust function is realized by rotation around the rotating parts 16 serving as center points and cooperation with the angle adjustment and limiting structure.

In order to improve the waterproofing effect, a limiting pillar 20 is fixed in each box type bracket 8; the female head copper pins 9 are of L-shaped structures; one end of each female head copper pin 9 is plugged in the limiting pillar 20 of the right fixed frame 7; one or more connection guide wire groups 21 are fixed in the right bracket 5; one end of each connection guide wire group 21 is electrically connected to the power supply device 2, and the other end of each connection guide wire group 21 is connected with the female head copper pin 9 on the right fixed frame 7; a rotatable limiting slot 46 is formed in the right bracket 5; the female head copper pins 9 in the right fixed frames 7 are clamped in the rotatable limiting slot 46; positioning slots 22 are formed in the bar plugs 11 on the right sides; the male head copper pins 12 are inserted into the positioning slots 22; the limiting pillars 20 are plugged into the positioning slots 22; and second waterproof pads 24 are fixed on the back surfaces of the box type brackets 8. The limiting pillars 20 are fixed outside the female head copper pins 9, and the positioning slots 22 are fixed outside the male head copper pins 12, so that when the female head copper pins 9 and the male head copper pins 12 are plugged with each other, the limiting pillars 20 are ensured to be plugged into the positioning slots 22. In this way, damage of the copper needles due to the fact that water enters the holes can be avoided, and the waterproofing effect can be further improved. In addition, the second waterproof pads 24 are fixed on the back surfaces of the box type brackets 8. In this way, the water enters the brackets through the through holes of the adjustment bolts 16 cooperating with the brackets, which affects the safety of the internal lines, thereby further improving the waterproofing effect and the safety.

As shown in FIG. 16, FIG. 17, FIG. 18, and FIG. 19, further, in order to ensure that the wiring is stabler, the box type bracket 8 and the female head copper needle 9 are formed by integrated encapsulation. One end of the female head copper needle 9 is provided with a copper sleeve 9-1; the male head copper needle 12 and the bar plug 11 are formed by integrated encapsulation; the male head copper needle 12 is of an L-shaped structure; and one end of the male head copper needle 12 is plugged into the copper sleeve 9-1. During mounting, one end of the male head copper needle 12 is plugged into a patch connector 3-1 of a lamp panel in the LED bar 3, and the other end of the male head copper needle 12 is plugged into the copper sleeve 9-1 of the female head copper needle 9, so as to realize circuit connection. In this structure, the female head copper needle 9 and the box type bracket 8 are formed by integrated encapsulation, and the male head copper needle 12 and the bar plug 11 are formed by integrated encapsulation, so that the overall strength is enhanced. Furthermore, the male head copper needle 12 and the female head copper needle 9 are plugged so that the wiring is more convenient, and the positioning is more accurate. Moreover, the encapsulation design ensures flexible rotation and stabler wiring.

In the present embodiment, two female head copper pins 9 are fixed in the limiting pillar 20 of the right fixed frame 7, so that there are also two corresponding male head copper pins 12. Meanwhile, the two female head copper pins 9 in the limiting pillar 20 of each right fixed frame 7 are snapped in the rotatable limiting slot 46 to ensure that when the female head copper pin 9 on the left side resists against the left side of the rotatable limiting slot 46, the whole right fixed frame 7 cannot continue to rotate anticlockwise and that when the female head copper pin 9 on the right side resists against the left side of the rotatable limiting slot 46, the whole right fixed frame 7 cannot continue to rotate clockwise, thus finally realizing further limitation to the rotation angle of the LED bar 3. As a preferential consideration, the rotation angle range of the LED bar 3 by the rotatable limiting slot 46 may be set according to an actual requirement, which may be +/−10 to +/−60 degrees, and the angle range is an integer, such as +/−30 degrees. That is, the maximum rotation range is rotating −30 degrees towards the left side and rotating +30 degrees towards the right side.

In order improve the waterproofing effect, a circle of third waterproof pad 45 is fixed at the bottom of the limiting pillar 20. The third waterproof pad 45 resists against the inner wall of the positioning slot 22 to improve the waterproofing effect.

For convenience of operation, each elastic buckle 13 includes an elastic body 25 with the upper end connected with the bar plug 11; the elastic body 25 is provided with a triangular hook part 26; one end part of the triangular hook part 26 is outwards disposed and cooperates with the buckle slot 10; a bent part 27 is fixed below the triangular hook part 26; an operation extending part 14 is fixed below the bent part 27; and the operation extending part 14 downwards extends out of a lower opening of the box type bracket 8. Since the operation extending part 14 extending out of the lower opening of the box type bracket 8 is fixed below the elastic buckle 13, during later removal, the front and rear operation extending parts 14 on the left side are directly held with the thumb and the index finger of the left hand, and the front and rear operation extending parts 14 on the right side are held with the thumb and the index finger of the right hand; the two hands clench the operation extending parts towards the centers of the box type brackets 8 at the same time to finally ensure that the upper triangular hook parts 26 are separated from the buckle slots 10; then the two sides are pulled down to remove the LED bar 3 needing to be removed; during mounting, two sides of the LED bar 3 are held and are snapped in the right fixed frame 7 and the left fixed frame 6 forcibly; the triangular hook parts 26 on two sides retract first under the elastic action and restore at the buckle slots 10, so that the triangular hook parts 26 are directly snapped in the buckle slots. The whole mounting operation is relatively convenient.

Figure 15:
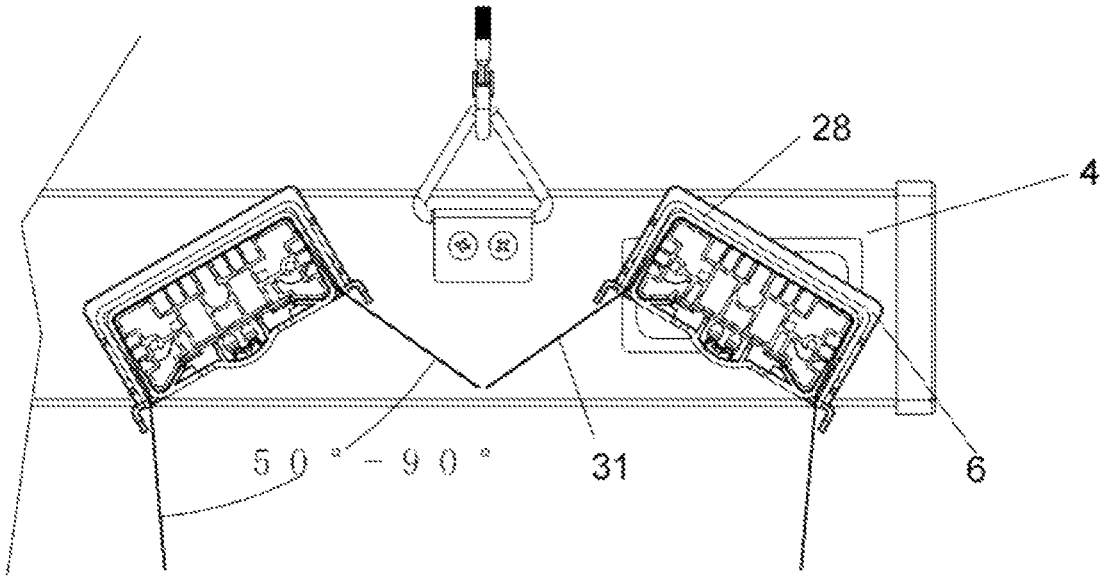
FIG. 15 is a partially schematic structural diagram from right to left when a left bracket is provide with an LED bar.

In order to improve the condensation effect, one reflector 28 is connected above each LED bar 3 through a thumb screw 29; a reflection angle of the reflector 28 is 50 to 90 degrees. In the present embodiment, the reflector 28 includes a box type mounting plate 30; two sides of the box type mounting plate 30 are provided with light reflection inclined plates 31 that are outwards inclined; and the reflector 28 is covered above the LED bar 3. As shown in FIG. 15, the reflection angle of the reflector 28 is an angle between the light reflection inclined plates 31 on the two sides. The reflector 28 is directly covered on the LED bar 3 with the thumb screw 29, and the light reflection inclined plates 31 are fixed on two sides below the reflector 28, so that the condensation effect is further improved; and the light reflection inclined plates 31 are used to refract the condensed light for the second time to further diffuse the light and increase the illumination range. The box type mounting plate 30 in the present embodiment is of a "⊔"-shaped structure. The reflector 28 and the luminaire rotation structure are used to effectively improve the luminance and increase the photosynthetic photon flux density.

As a preference, for convenience of installation and removal, each of the left bracket 4 and the right bracket 5 is provided with one or more steel wire rope hooks 32. When it is necessary to install this device in the later stage, the other end of the steel wire rope hook 32 is fixed at a position for installation to realize quick installation of the whole illumination light. The illumination light is also convenient to remove in the later stage.

As a preference, in order to further improve the waterproofing effect, each of the left bracket 4 and the right bracket 5 includes a bracket main body 35 and a bracket side plate 36; the bracket side plate 36 is in buckled connection with the bracket main body 35; each of two ends of the bracket main body 35 is provided with an end cover 39; a first waterproof pad 38 is fixed between each end cover 39 and the bracket main body 35; and one or more waterproof bars 37 are fixed in the bracket side plate 36. In this structural design, the left bracket 4 and the right bracket 5 are detachably buckled. Each of the left bracket 4 and the right bracket 5 includes the bracket main body 35 and the bracket side plate 36 buckled with the bracket main body 35, and then the two end covers 39 are fixed on the two sides of the bracket main body 35 through screws to form a complete bracket, which is finally convenient for assembling the internal waterproof bars 37 and the connection guide wire groups 21 and is also convenient for maintaining and replacing the waterproof bars 37 or the connection guide wire groups 21 in the later stage; and furthermore, the inner walls of the end sockets are provided with the first waterproof pads 38 to further improve the waterproofing effect in the bracket 4 and the right bracket 5.

As a preference, for convenience of removal, the rotating part 16 is an adjustment bolt; and a built-in nut 15 in threaded connection with the adjustment bolt is fixed in the box type bracket 8. By means of the above-mentioned structural arrangement, the box type bracket 8 is convenient to mount. The bracket main body 35 and the bracket side plate 36 need to be disassembled first, and the adjustment bolt penetrates through the corresponding limiting hole 44 above the bracket main body 35 and is in threaded connection with the corresponding built-in nut 15, so that the box type bracket 8 can be fixed on the left bracket 4 or the right bracket 5; and a screw rod part of the adjustment bolt is inserted into the limiting hole 44, so that the screw rod can rotate in the positioning hole 43.

As a preference, in order to improve the heat dissipation effect, each LED bar 3 includes an aluminum heat dissipation luminaire holder 42 and an LED panel 41 with LED beads; and the LED panel 41 is fixed on the lower surface of the aluminum heat dissipation luminaire holder 42. There are two specific mounting methods for disposing the LED panel 41 on the aluminum heat dissipation luminaire holder 42 below: The first mounting method is used in the present embodiment: The LED panel 41 is inserted from the side surface of the aluminum heat dissipation luminaire holder 42 first and is then fixed in a reinforced manner by a screw. This structural arrangement can prevent the LED panel from being partially subjected to warp deformation; the LED panel is in close fit with a heat dissipater to improve the heat dissipation effect; meanwhile, in an actual situation, the second mounting method can also be used: The LED panel 41 is flatly placed on the aluminum heat dissipation luminaire holder 42 and is fixed by a screw.

As a preference, the upper surface of the aluminum heat dissipation luminaire holder 42 is provided with a first heat dissipation insertion slot 40 that is inwards sunken; the first heat dissipation insertion slot 40 extends in a lengthwise direction of the aluminum heat dissipation luminaire holder 42; two sides of the first heat dissipation insertion slot 40 are provided with one or more first heat dissipation racks 23; and the thumb screw 29 is in threaded fit with the first heat dissipation insertion slot 40. In this structure, one first heat dissipation insertion slot 40 is formed in the center of the upper surface of the aluminum heat dissipation luminaire holder 42, and two sides of the inner wall of the first heat dissipation insertion slot 40 are provided with a plurality of first heat dissipation racks 23; furthermore, the whole aluminum heat dissipation luminaire holder 42 is ensured to be of a square structure so that the whole light body is regularly shaped; the thumb screw 29 is in threaded connection with the bottom of the first heat dissipation insertion slot 40 to realize convenient mounting of the reflector above; moreover, the first heat dissipation racks 23 can also be used to guide heat to further improve the heat dissipation effect; during mounting of the reflection hood, the thumb screw 29 can be directly manually screwed to tighten a preset internal thread in the first heat dissipation insertion slot 40 formed in the aluminum heat dissipation luminaire holder 42; and the reflector is finally mounted by manual screwing, so that it is convenient to remove, and tool-free operation is realized.

Embodiment 2

Figure 16:
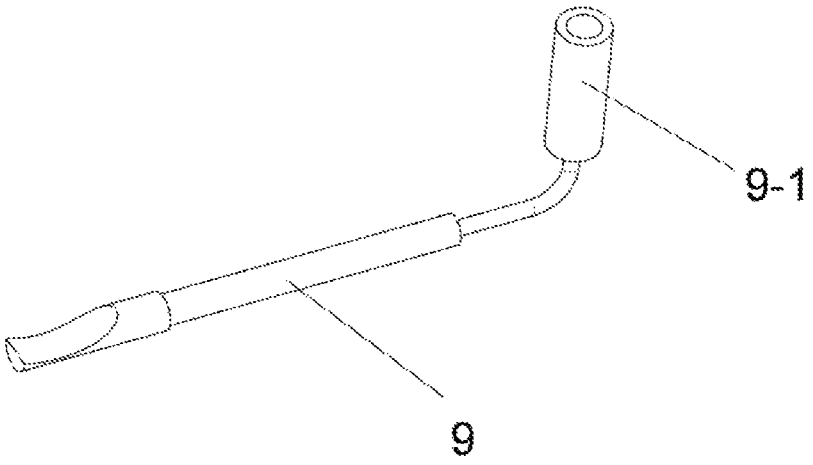
FIG. 16 is a schematic structural diagram of a female head copper needle.
Figure 17:
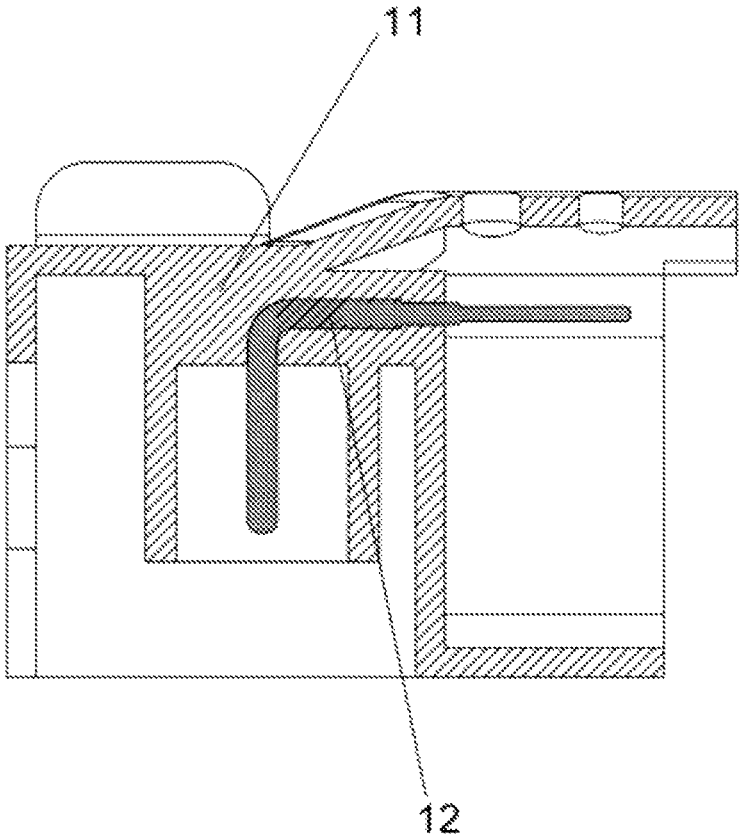
FIG. 17 is a schematic diagram of an internal section after a bar plug and a male head copper needle are assembled.
Figure 18:
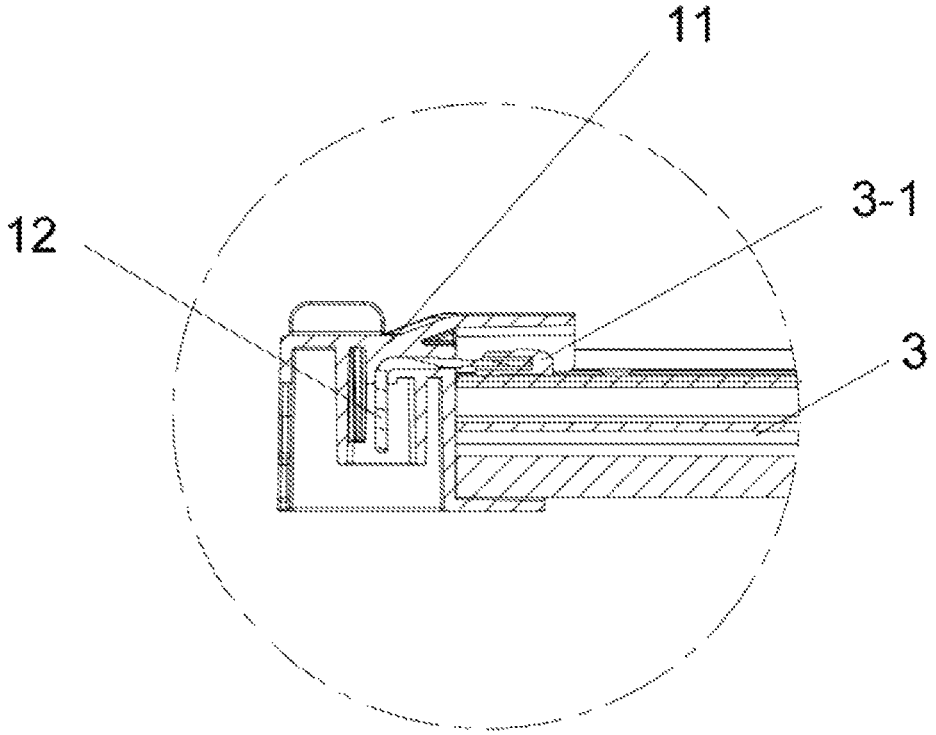
FIG. 18 is a schematic diagram of an internal structure after a bar plug and an LED bar are assembled.
Figure 19:
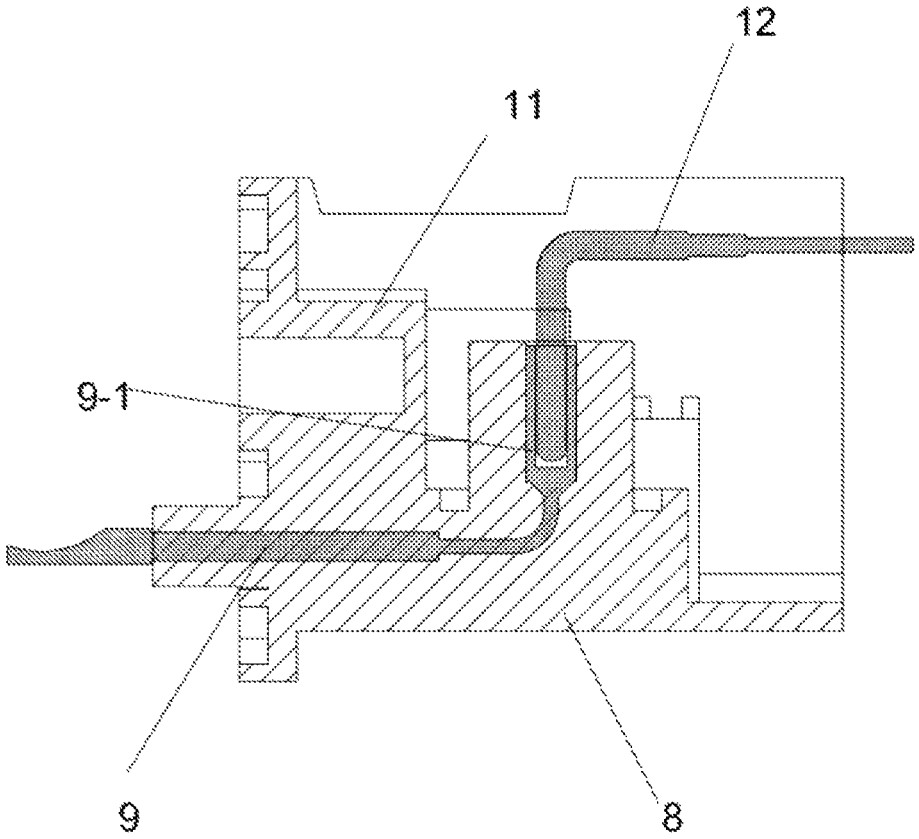
FIG. 19 is a sectional view when a male head copper needle and a female head copper needle are connected.
Figure 20:
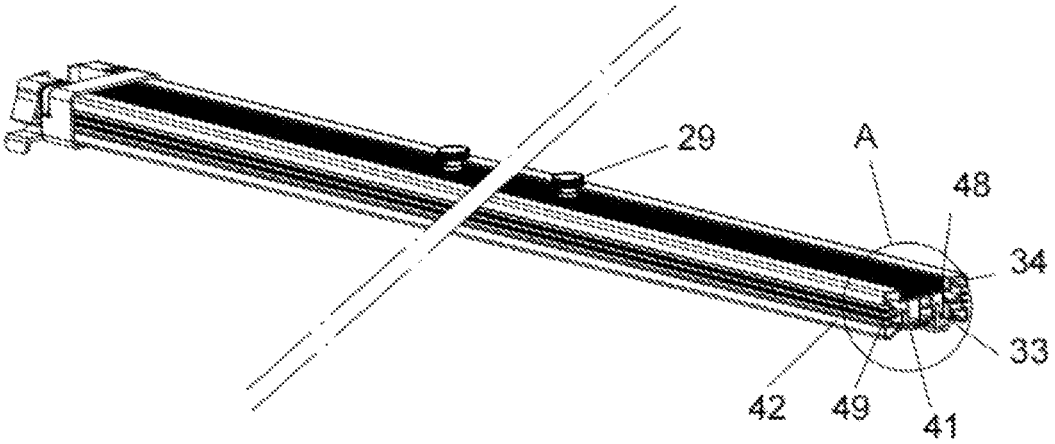
FIG. 20 is a schematic structural diagram of an LED bar and a bar plug on the left side in Embodiment 2.
Figure 21:
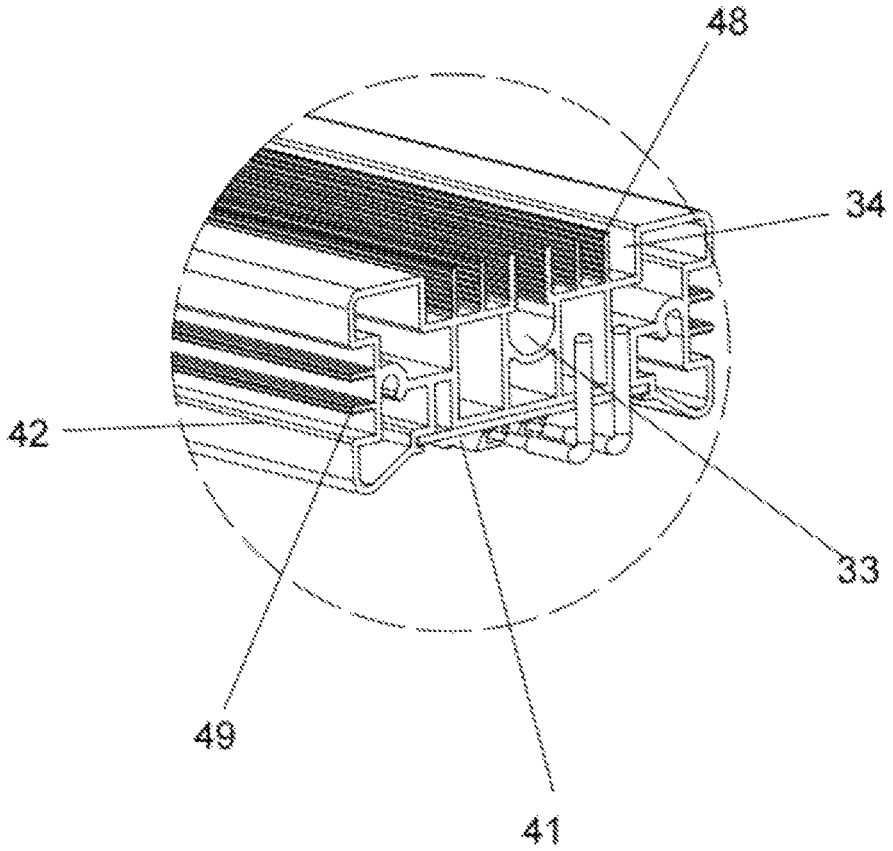
FIG. 21 is an enlarged diagram of the part A of FIG. 20.

Referring to FIG. 15 and FIG. 16, according to a luminaire disclosed by the present embodiment, as a preference, the upper surface of the aluminum heat dissipation luminaire holder 42 is provided with a heat dissipation groove 34; a screw fixing slot 33 extending downwards is fixed in the heat dissipation groove 34; the screw fixing slot 33 is in cooperating connection with the thumb screw 29; the heat dissipation groove 34 and the screw fixing slot 33 extend in the lengthwise direction of the aluminum heat dissipation luminaire holder 42; one or more first heat dissipation ribs 48 extending upwards are further fixed in the heat dissipation groove 34; and two sides of the aluminum heat dissipation luminaire holder 42 are provided with one or more second heat dissipation ribs 49. By means of the above-mentioned structural setting, the heat dissipation ribs are not only fixed above the aluminum heat dissipation luminaire holder 42, but also on the side edges of the aluminum heat dissipation luminaire holder 42, thus further improving the heat dissipation effect; and meanwhile, the heat dissipation groove 34 realizes two functions: it serves as a heat dissipation slot in the first function, and serves as a screw fixing slot in the other function.

This applicant needs to explain that the supporting frame 1 in the present application may be a rod body made of an iron sheet metal material or a circular or triangular structure formed by extruding a lightweight stick. The lightweight stick may be an aluminate material. Meanwhile, the heat dissipater in the document of the present application has a variety of shapes and can be matched with the bar plug on the right side.

For those skilled in the art, it is apparent that the present disclosure is not limited to the details of the demonstrative embodiments mentioned above, and that the present disclosure can be realized in other specific forms without departing from the spirit or basic features of the present disclosure. Therefore, from any point of view, the embodiments should be regarded as exemplary and non-limiting. The scope of the present disclosure is defined by the appended claims rather than the above description. Therefore, all changes falling within the meanings and scope of equivalent elements of the claims are intended to be included in the present disclosure. No drawing markings in claims shall be deemed to limit the claims involved.

What is claimed is:

1. A luminaire, comprising a supporting frame, a power supply device, and one or more LED bars, wherein the power supply device is fixed on the supporting frame; two sides of the supporting frame are provided with a left bracket and a right bracket; one or more left fixed frames are fixed on the side edge of the left bracket; right fixed frames symmetric to the left fixed frames one by one are fixed on the side edge of the right bracket, one LED bar is buckled between the symmetric left fixed frame and right fixed frame in each group; the right fixed frames and the left fixed frames each comprise one box type bracket; the front and rear ends of each box type bracket are each provided with one buckle slot; the left and right ends of each LED bar are each provided with one bar plug; the inner sides of the box type brackets of the right fixed frames are provided with female head copper pins electrically connected to the power supply device; the bar plugs on the right sides are provided with male head copper pins; one end of each male head copper pin is matched with each female head copper pin-, and the other end is electrically connected to each LED bar; the front and rear ends of each bar plug are each provided with one elastic buckle; the elastic buckles cooperate with the buckle slots; the right fixed frames and the left fixed frames are rotatably connected with the corresponding left bracket or right bracket through one angle adjustment mechanism; the angle adjustment mechanism comprises one rotating part, two elastic positioning devices symmetrically fixed on two sides of the rotating part, and two angle adjustment limiting regions cooperating with the two elastic positioning devices; and each angle adjustment limiting region comprises one or more angle adjustment gears.

2. The luminaire according to claim 1, wherein the left bracket and the right bracket are provided with limiting holes cooperating with the rotating parts and positioning holes cooperating with the elastic positioning devices; one end of each rotating part is connected with the box type brackets; the two angle adjustment limiting regions are two symmetric arc-shaped limiting slots formed in the back surfaces of the box type brackets; each group of arc-shaped limiting slot is formed by splicing one or more semicircular grooves; two adjacent semicircular grooves communicate with each other; an included angle between two circle centers of two adjacent semicircular grooves) is 0 to 10 degrees; the bottoms of the elastic positioning devices on two sides of the rotating parts are snapped in the corresponding positioning holes; and elastic ends of the elastic positioning devices on two sides are mounted in the left and right symmetric semicircular grooves.

3. The luminaire according to claim 1, wherein a limiting pillar is fixed in each box type bracket; the female head copper pins are of L-shaped structures; one end of each female head copper pin is plugged in the limiting pillar of the right fixed frame; one or more connection guide wire groups are fixed in the right bracket; one end of each connection guide wire group is electrically connected to the power supply device, and the other end of each connection guide wire group is connected with the female head copper pin on the right fixed frame; a rotatable limiting slot is formed in the right bracket; the female head copper pins in the right fixed frames are clamped in the rotatable limiting slot; positioning slots are formed in the bar plugs on the right sides; the male head copper pins are inserted into the positioning slots; the limiting pillars are plugged into the positioning slots-; and second waterproof pads are fixed on the back surfaces of the box type brackets.

4. The luminaire according to claim 3, wherein each box type bracket and each female head copper pin are formed by A integrated encapsulation; one end of each female head copper pin is provided with a copper sleeve; each male head copper pin and each bar plug are formed by integrated encapsulation; each male head copper pin is of an L-shaped structure; and one end of each male head copper pin is plugged into a corresponding one of each copper sleeve.

5. The luminaire according to claim 3, wherein each elastic buckle comprises an elastic body with the upper end connected with a corresponding one of the bar plugs; each elastic body is provided with a triangular hook part; one end part of each triangular hook part is outwards disposed and cooperates with a corresponding one of the buckle slots; a bent part is fixed below ach triangular hook part; an operation extending part is fixed below each bent part; and each operation extending part downwards extends out of a lower opening of a corresponding one of the box type brackets.

6. The luminaire according to claim 4, wherein one reflector is connected above each LED bar through a thumb screw; each reflector comprises a box type mounting plate; two sides of the box type mounting plate are provided with light reflection inclined plates that are outwards inclined; and each reflector is covered above a corresponding one of the LED bars.

7. The luminaire according to claim 5, wherein each of the left bracket and the right bracket comprises a bracket main body and a bracket side plate; ach bracket side plate is in buckled connection with a corresponding one of the bracket main bodies; each of two ends of each bracket main body is provided with an end cover; a first waterproof pad is fixed between each end cover and a corresponding one of the bracket main bodies; and one or more waterproof bars are fixed in each bracket side plate.

8. The luminaire according to claim 7, wherein each LED bar comprises an aluminum heat dissipation luminaire holder and an LED panel with LED beads; and each LED panel is fixed on the lower surface of a corresponding one of the aluminum heat dissipation luminaire holders.

9. The luminaire according to claim 8, wherein the upper surface of each aluminum heat dissipation luminaire holder is provided with a first heat dissipation insertion slot that is inwards sunken; each first heat dissipation insertion slot extends in a lengthwise direction of each aluminum heat dissipation luminaire holder; two sides of each first heat dissipation insertion slot are provided with one or more first heat dissipation racks; and a thumb screw is in threaded fit with each first heat dissipation insertion slot.

10. The luminaire according to claim 8, wherein each upper surface of the aluminum heat dissipation luminaire holder is provided with a heat dissipation groove; a screw fixing slot extending downwards is fixed in each heat dissipation groove; each screw fixing slot is in cooperating connection with a thumb screw; each heat dissipation groove and each screw fixing slot extend in the lengthwise direction of each aluminum heat dissipation luminaire holder one or more first heat dissipation ribs extending upwards are further fixed in each heat dissipation groove; and two sides of each aluminum heat dissipation luminaire holder are provided with one or more of the second heat dissipation ribs.

* * * * *